US008528798B2

(12) United States Patent
Chen

(10) Patent No.: US 8,528,798 B2
(45) Date of Patent: Sep. 10, 2013

(54) ELECTRONIC MOBILE DEVICE SUPPORT APPARATUS

(75) Inventor: Chao Chen, Waterloo (CA)

(73) Assignee: BlackBerry Limited, Waterloo, Ontario (CA)

( * ) Notice: Subject to any disclaimer, the term of this patent is extended or adjusted under 35 U.S.C. 154(b) by 319 days.

(21) Appl. No.: 12/875,387

(22) Filed: Sep. 3, 2010

(65) Prior Publication Data

US 2012/0055960 A1 Mar. 8, 2012

(51) Int. Cl.
*A45F 5/00* (2006.01)

(52) U.S. Cl.
USPC ..... 224/217; 224/218; 224/930

(58) Field of Classification Search
USPC ..... 224/217, 318, 930, 218; 401/8; 294/25
See application file for complete search history.

(56) References Cited

U.S. PATENT DOCUMENTS

| | | | | | |
|---|---|---|---|---|---|
| 1,836,223 | A | * | 12/1931 | Burns et al. | 294/25 |
| 4,020,527 | A | | 5/1977 | O'Neill | |
| 4,165,554 | A | | 8/1979 | Faget | |
| 4,202,139 | A | * | 5/1980 | Hong et al. | 451/524 |
| 4,754,499 | A | * | 7/1988 | Pirie | 2/20 |
| 5,142,131 | A | | 8/1992 | Collins, Jr. et al. | |
| 5,267,181 | A | | 11/1993 | George | |
| 5,404,267 | A | | 4/1995 | Silva et al. | |
| D381,129 | S | * | 7/1997 | Lawrence | D29/115 |
| 5,771,492 | A | | 6/1998 | Cozza | |
| 5,796,354 | A | | 8/1998 | Cartabiano et al. | |
| 5,805,474 | A | | 9/1998 | Danielson et al. | |
| 6,701,571 | B2 | * | 3/2004 | Hagen | 16/114.1 |
| 6,708,136 | B1 | | 3/2004 | Lahiff | |
| 6,726,070 | B2 | * | 4/2004 | Lautner | 224/221 |
| 7,307,620 | B2 | | 12/2007 | Siddeeq | |
| D587,896 | S | * | 3/2009 | Aipa | D3/201 |
| 7,661,567 | B2 | * | 2/2010 | Myers | 224/217 |
| 2004/0226973 | A1 | * | 11/2004 | Kao | 224/218 |
| 2005/0205622 | A1 | | 9/2005 | Liu | |
| 2005/0205623 | A1 | * | 9/2005 | Buntain | 224/217 |
| 2006/0164392 | A1 | | 7/2006 | Mao | |
| 2006/0180621 | A1 | * | 8/2006 | Ladouceur | 224/269 |
| 2006/0279098 | A1 | | 12/2006 | Shipley et al. | |
| 2007/0101479 | A1 | | 5/2007 | Turner | |
| 2009/0270050 | A1 | | 10/2009 | Brown | |
| 2010/0096284 | A1 | | 4/2010 | Bau | |
| 2010/0222118 | A1 | | 9/2010 | Interdanato | |
| 2012/0031937 | A1 | * | 2/2012 | Baker | 224/217 |

FOREIGN PATENT DOCUMENTS

| | | | |
|---|---|---|---|
| FR | 2812993 | A3 | 2/2002 |
| JP | 2005034526 | A | 2/2005 |
| WO | WO0226067 | A1 | 4/2002 |
| WO | WO2009081223 | A1 | 7/2009 |

OTHER PUBLICATIONS

Belkin, Hand Band, Part # F8Z541tt064, belkin.com online catalog, Copyright 2010 Belkin International, Inc.

(Continued)

*Primary Examiner* — Justin Larson
(74) *Attorney, Agent, or Firm* — Quarles & Brady LLP

(57) ABSTRACT

An electronic mobile device support apparatus includes a plurality of generally tubular finger receivers disposed adjacent a rear surface of an electronic mobile device. Each of the plurality of finger receivers defines a passageway configured to receive a corresponding finger of an electronic mobile device user such that the electronic mobile device is supportable thereby.

20 Claims, 5 Drawing Sheets

(56) References Cited

OTHER PUBLICATIONS

Fujitsu America, Inc., Hand Strap, Product #FPCETC13, store.shopfujitsu.com online catalog, Copyright 2000-2010 Fujitsu America, Inc.

OtterBox, Fujitsu Stylistic Tablet Case 4600, otterbox.com online catalog, Copyright 2010 OtterBox.

Marware, Eco-Flip for iPad, marware.com online catalog.

European Patent Office, Partial European Search Report, Application No. EP 10 17 5324, Feb. 28, 2011.

European Patent Office, Extended European Search Report, Application No. 10175324.2, Jun. 30, 2011.

* cited by examiner

ELECTRONIC MOBILE DEVICE SUPPORT APPARATUS

CROSS-REFERENCE TO RELATED APPLICATION

Not applicable.

STATEMENT OF FEDERALLY SPONSORED RESEARCH OR DEVELOPMENT

Not applicable.

BACKGROUND OF THE DISCLOSURE

The present disclosure generally relates to supports, sleeves, or "skins" for securely holding electronic mobile devices.

Small electronic mobile devices, e.g., mobile communication devices such as pagers, cellular phones, global positioning system (GPS) navigation devices and other satellite navigation devices, smart phones, wireless organizers, wireless personal digital assistants (PDA), and the like are typically easy to simultaneously hold and manipulate due to the size of these devices compared to the size of a user's hands. Moreover, the relatively small sizes permit users to comfortably simultaneously hold and manipulate these devices in several different manners.

For example, one manner includes using the pads of the fingers on both of a user's hands to support the rear surface of the device. The thumbs on both hands are then free to manipulate the device (e.g., actuate keys, a track ball, a track pad, a touch-sensitive display, or the like). As another example, another manner of simultaneously holding and manipulating a small electronic mobile device includes gripping a device between the palm and the fingers on the same hand. The thumb on the same hand and all the fingers on the opposite hand are then free to manipulate the device.

Unfortunately, the above manners of holding and manipulating electronic mobile devices typically become more difficult when using large electronic mobile devices, such as tablet computers, notebook computers, electronic readers, and the like, each of which may have a display size of 10" or greater and a thickness of 0.5" or greater. For example, placing the pads of the fingers on the rear surface of the device and using the thumbs to manipulate the device may be impractical because the thumbs may not be able to reach all areas of the front of the device.

Furthermore, gripping a large electronic mobile device between the palm and the fingers using one hand may also be impractical. However, this manner of holding a large electronic mobile device may be modified to be slightly more effective. For example, a user may attempt to "pinch" an edge of the device between the thumb and the fingers of one hand, although such a grip can quickly fatigue the user's hand. Alternatively, a user can rest the device on the palm and fingers of one hand and manipulate the device with the other hand. However, the device can easily be dropped because the user is not truly gripping the device.

DETAILED DESCRIPTION

According to some embodiments, an electronic mobile device support apparatus comprises a plurality of generally tubular finger receivers disposed adjacent a rear surface of an electronic mobile device. Each of the plurality of finger receivers defines a passageway configured to receive a corresponding finger of an electronic mobile device user such that the electronic mobile device is supportable thereby.

The teachings of the present disclosure generally relate to supports, sleeves, or "skins" for large electronic mobile devices with or without wireless communication capabilities, e.g., tablet computers, notebook computers, electronic readers, or other electronic mobile devices in which a surface on which a user places a hand to support the device is larger than the surface area covered by the average person's hand. However, it is also possible that the teachings of the present disclosure could be applied to supports for small electronic mobile devices, e.g., pagers, cellular phones, global positioning system (GPS) navigation devices and other satellite navigation devices, smart phones, wireless organizers, wireless personal digital assistants (PDAs), electronic gaming devices, digital photograph albums or picture frames, digital cameras, digital video recorders, and the like and used with individuals that are prone to dropping such devices (e.g., children).

Referring now to FIGS. 1-5, an electronic mobile device support apparatus 130 includes a case 132 that houses an electronic mobile device 100. The case 132 supports a plurality of finger receivers 234 that accommodate and snugly engage the fingers 210A, 210B, 210C, and 210D of a user of the device. As such, the user does not need to attempt to support the case 132 and the device 100 in an uncomfortable manner or a manner in which the device 100 is relatively likely to be dropped. In the following paragraphs, the case 132 of the support apparatus 130 is first generally described. Thereafter, additional details of the finger receivers 234 and alternative embodiments of the support apparatus 130 are described.

Figure 1:
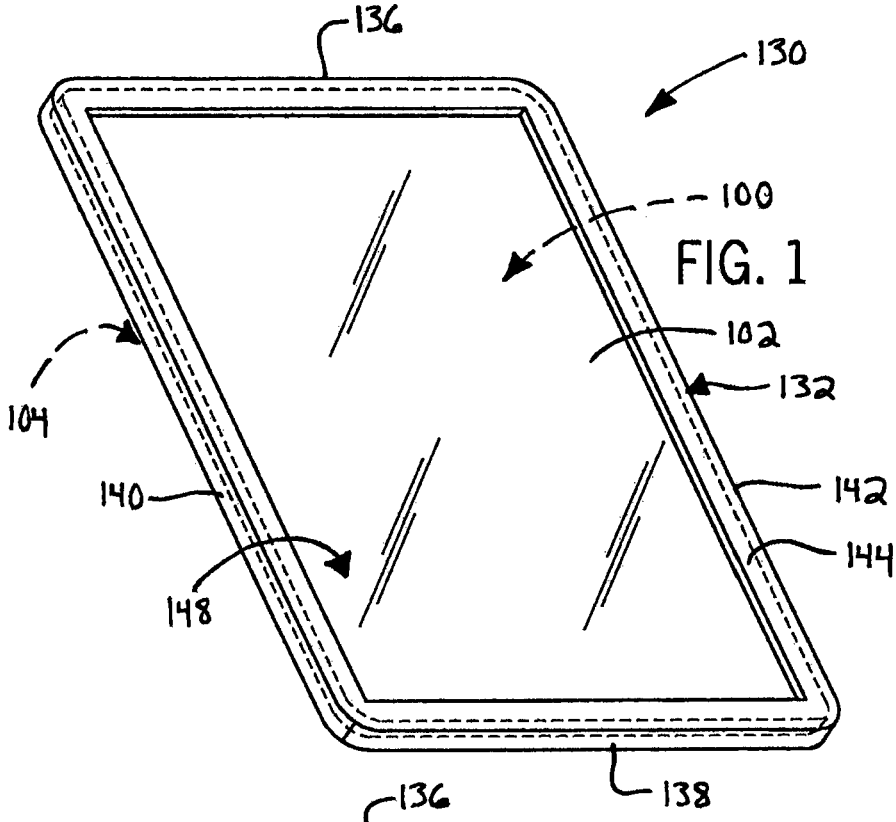
FIG. 1 is a front perspective view of an electronic mobile device housed within a support apparatus.
Figure 2:
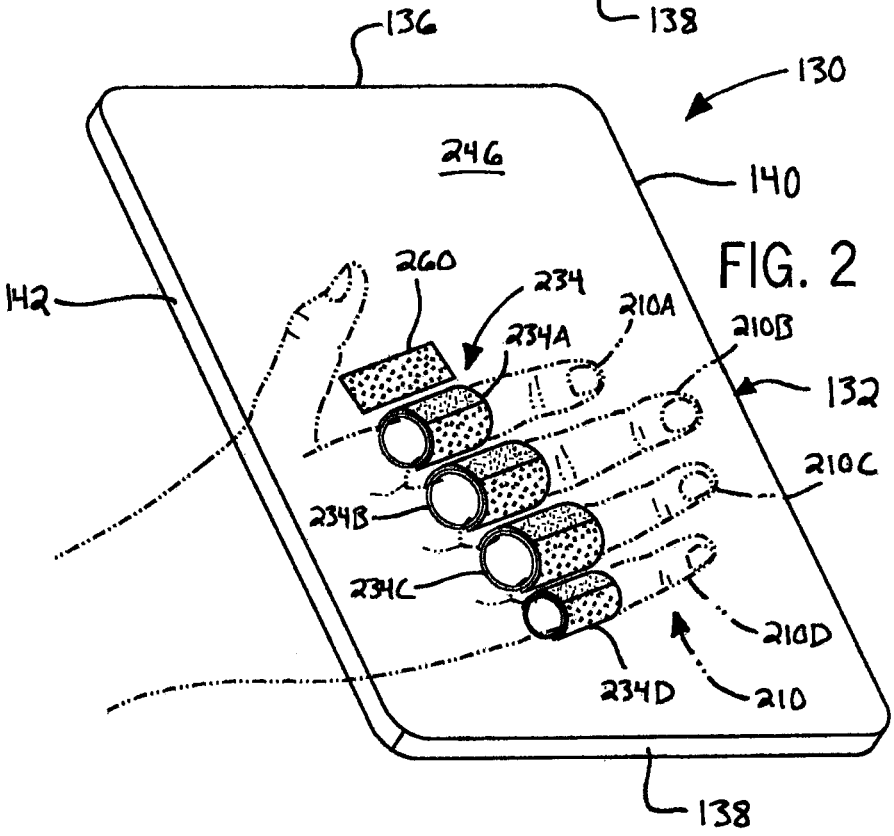
FIG. 2 is a rear perspective view of the electronic mobile device support apparatus of FIG. 1 illustrating finger receivers of the apparatus.
Figure 3:
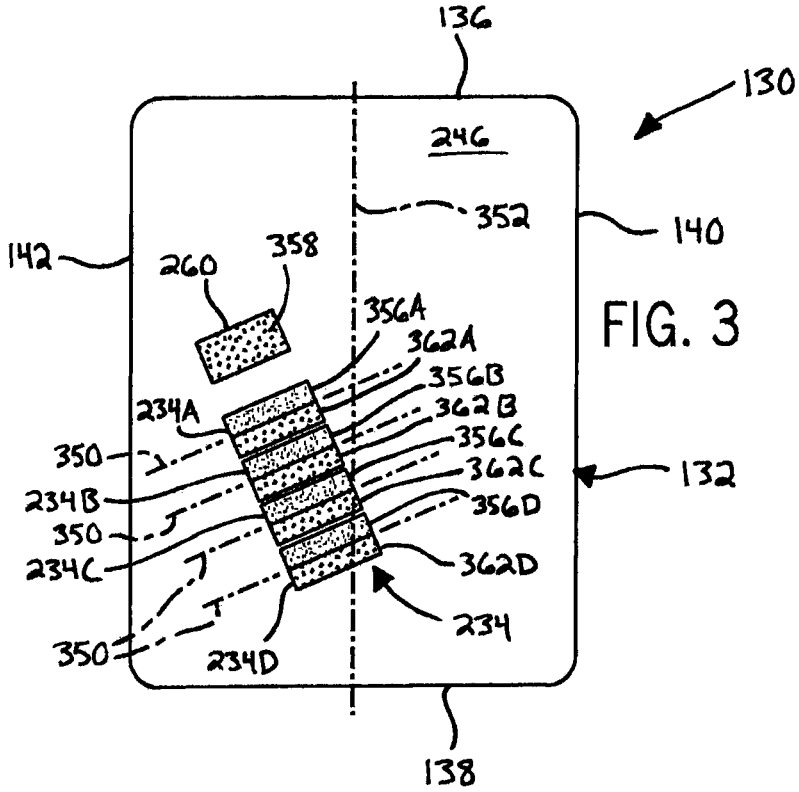
FIG. 3 is a rear view of the electronic mobile device support apparatus of FIG. 1.

Referring first to FIGS. 1 and 2, the case 132 generally provides a protective housing for the electronic mobile device. In particular, the case 132 is a generally three-dimensional rectangular structure that includes a top 136, a bottom 138, and sides 140 and 142 disposed adjacent the sides of the electronic mobile device 100. The case 132 also includes a front bezel 144 that, in some embodiments, supports a transparent panel (not shown) adjacent a display 102 of the electronic mobile device 100. A rear surface 246 (FIG. 2) of the case 132 is disposed opposite the front bezel 144 and adjacent a rear surface 104 of the device 100. Together, the top 136, the bottom 138, the sides 140 and 142, the front bezel 144, and the rear surface 246 define an internal compartment 148 that houses the electronic mobile device 100.

The case 132 comprises one or more materials that are commonly associated with device sleeves and skins, such as polymers (e.g., polycarbonate, polychloroprene, polyurethane, silicone, and rubber), fabrics (e.g., nylon), leather, imitation leather, and the like. If the case 132 comprises a deformable material, meaning that the case 132 is capable of undergoing significant deflection when a load is applied thereto without experiencing permanent deformation, the electronic mobile device 100 may enter and exit the case 132 by temporarily deforming the bezel 144 and passing through the opening defined by the bezel 144. On the other hand, in some embodiments in which the case 132 does not comprise a deformable material, one of the top 136, the bottom 138, and the sides 140 includes a slot (not shown) or is detachable from the rest of the case 132 to permit the electronic mobile device 100 to enter and exit the case 132.

Referring now to FIGS. 2-5, the rear surface 246 of the case 132 supports the finger receivers 234 opposite the internal compartment 148. As briefly described above and as the name implies, the finger receivers 234A, 234B, 234C, and 234D accommodate and snugly engage a user's fingers 210A, 210B, 210C, and 210D, respectively. As such, the user may comfortably support the device 100 using one hand while manipulating the device 100 with the opposite hand.

In general, each of the finger receivers 234 has a generally tubular structure. As used herein, the term "generally tubular" and variations thereof mean that a component has two open ends with a wall of material defining a passageway between the two open ends. Furthermore, a generally tubular component can have various cross-sectional shapes. In some embodiments, the size of the finger receivers 234 differ so as to be appropriately sized for each corresponding finger. For example, in some embodiments the index finger receiver 234A is relatively large and the small finger receiver 234D is relatively small.

In addition, the finger receivers 234 are oriented and positioned on the rear surface 246 to permit the user to comfortably support the device 100. In particular, each of the finger receivers 234 defines a longitudinal axis 350 (FIG. 3) that extends perpendicularly through the open ends of the receiver 234. The longitudinal axes 350 are parallel to one another and are non-perpendicular to a longitudinal axis 352 of the case 132 (i.e., an axis that bisects the case 132 and extends through the top 136 and the bottom 138). This permits the user to support the device 100 in a position in which the forearm extends diagonally (as if the user was to look at the palm of their hand). Moreover, the index finger receiver 234A is offset from the longitudinal axis 352 of the case 132 toward one of the sides 140, 142 of the case 132. This permits the user to position the thumb 12 against the rear surface 246 of the case 132 or adjacent the front bezel 144; some users may find one of these arrangements more comfortable than the other.

Figure 4:
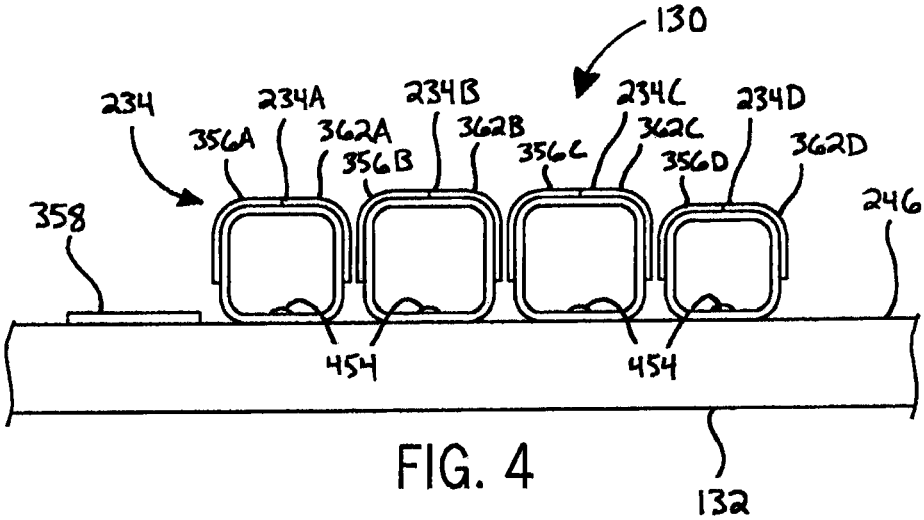
FIG. 4 is a side view of the electronic mobile device support apparatus of FIG. 1 illustrating the finger receivers in a standing position.

Exemplary materials for the finger receivers 234 include one or more of polymers (e.g., polycarbonate, polychloroprene, polyurethane, silicone, and rubber), fabrics (e.g., nylon), leather, imitation leather, and the like. Furthermore, in some embodiments, the finger receivers 234 comprise the same material as the case 132, and in other embodiments, the finger receivers 234 comprise a different material from the case 132. Depending on the specific material, the finger receivers 234 can connect to the rear surface 246 of the case 132 in various manners. For example, fabric, leather, or polychloroprene finger receivers can connect to the rear surface 246 via stitches 454 (FIG. 4). As another example, polymer finger receivers can connect to the rear surface 246 by permanent or releasable adhesives (not shown).

Figure 5:
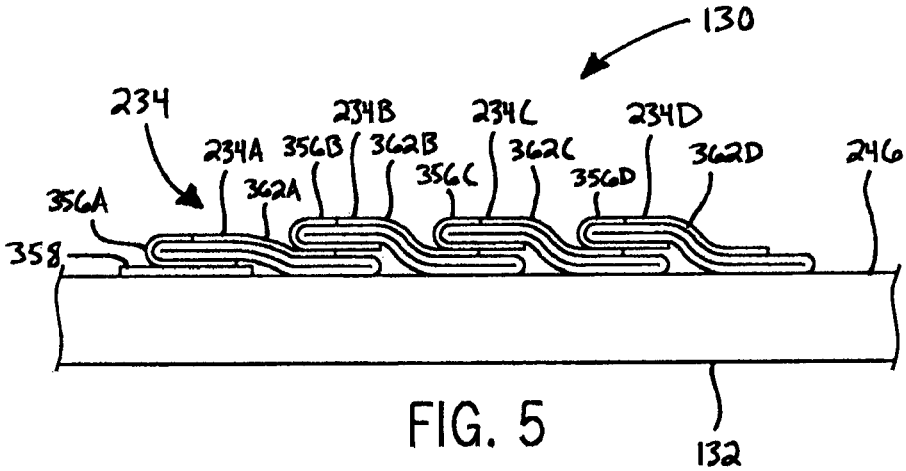
FIG. 5 is a side view of the electronic mobile device support apparatus of FIG. 1 illustrating the finger receivers in a collapsed position.

The material of the receivers 234 is deformable and, as such, the finger receivers 234 can assume the generally cylindrical shape of the user's fingers 210 when the fingers 210 are placed therein (FIG. 2). In addition, this deformability provides at least two other advantages. First, a user may bend the fingers 210 within the finger receivers 234 to provide even further secure support for the electronic mobile device 100. Second, the finger receivers 234 may be moved to a collapsed position in which the receivers 234 are flattened toward the rear surface 246 of the case 132 (FIG. 5). In the collapsed position, the finger receivers 234 conveniently reduce the overall thickness of the case 132, e.g., for travelling, storage, or the like.

Furthermore, to hold the finger receivers 234 in the collapsed position, each finger receiver 234 includes connection surfaces (e.g., separate Velcro® hook and loop surfaces) that releasably engage the adjacent receiver or receivers 234. In particular, the index finger receiver 234A has a first connection surface 356A (e.g., Velcro® hooks, FIG. 3) that engages a second connection surface 358 (e.g., Velcro® loops) of an additional pad 260 supported by the rear surface 246. Engagement between the surfaces 356A, 358 holds the index finger receiver 234A in the collapsed position. Similarly, the index finger receiver 234A also has a second connection surface 362A (e.g., Velcro® loops, FIG. 3) that engages a first connection surface 356B of the middle finger receiver 234B. Engagement between the surfaces 362A, 356B holds the middle finger receiver 234B in the collapsed position. The middle finger receiver 234B also has a second connection surface 362B that engages a first connection surface 356C of the ring finger receiver 234C. Engagement between the surfaces 362B, 356C holds the ring finger receiver 234C in the collapsed position. Lastly, the ring finger receiver 234C has a second connection surface 362C that engages a first connection surface 356D of the small finger receiver 234D. Engagement between the surfaces 362C, 356D holds the small finger receiver 234D in the collapsed position.

In some embodiments, the small finger receiver 234D also has a second connection surface 362D to engage a second pad (not shown) supported by the rear surface 246. As such, the finger receivers 234 may be collapsed in the opposite direction from the configuration shown in FIG. 5 (i.e., towards the bottom 138 of the case 132 instead of the top 136). In any case, the finger receivers 234 can be moved back to the standing position (FIGS. 2-4) by pulling each finger receiver 234 apart from the adjacent finger receiver or receivers 234.

Figure 6:
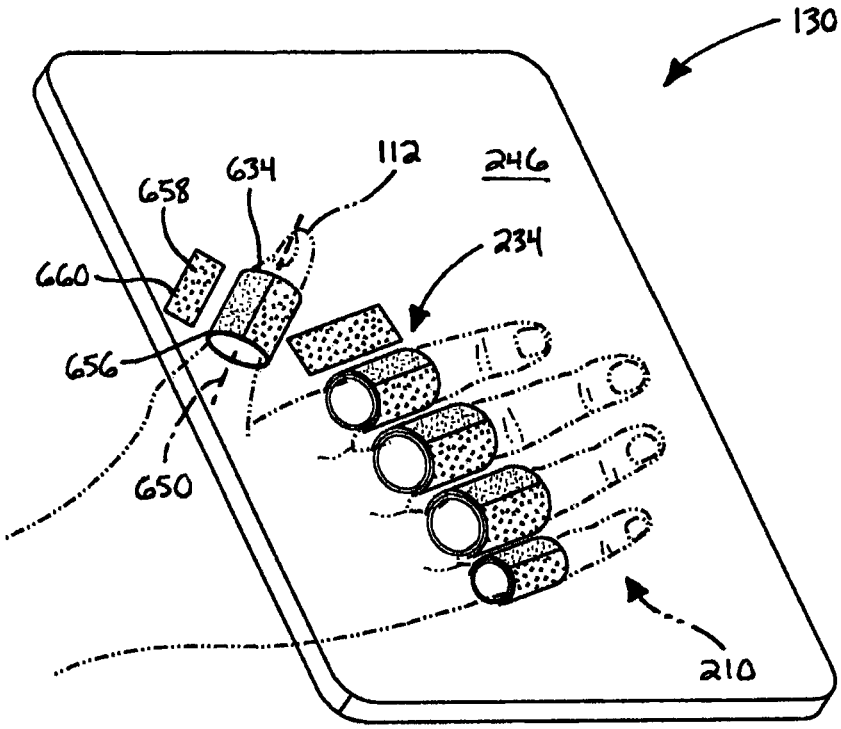
FIG. 6 is a rear perspective view of the electronic mobile device support apparatus further including a finger receiver for a user's thumb.

The support apparatus 130 described above may be modified in various manners without departing from the scope of the disclosure. For example and referring to FIG. 6, the apparatus 130 may further include an additional thumb "finger" receiver 634 that, as the name implies, accommodates the thumb 112 on the same hand as the fingers 210. The thumb receiver 634 is generally similar to the finger receivers 234 described above. Notably, the thumb receiver 634 includes a first connection surface 656 (e.g., Velcro® hooks) that engages a second connection surface 658 (e.g., Velcro® loops) of an additional pad 660 supported by the rear surface 246 of the case 132. As such, engagement between the surfaces 656, 658 holds the thumb receiver 634 in the collapsed position. Unlike the other finger receivers 234, however, the longitudinal axis 650 of the thumb receiver 634 is non-parallel to the longitudinal axes 350 of the finger receivers 234. Such a configuration may be preferred by some users because the thumb receiver 634 provides additional stability when supporting the electronic mobile device 100.

Figure 7:
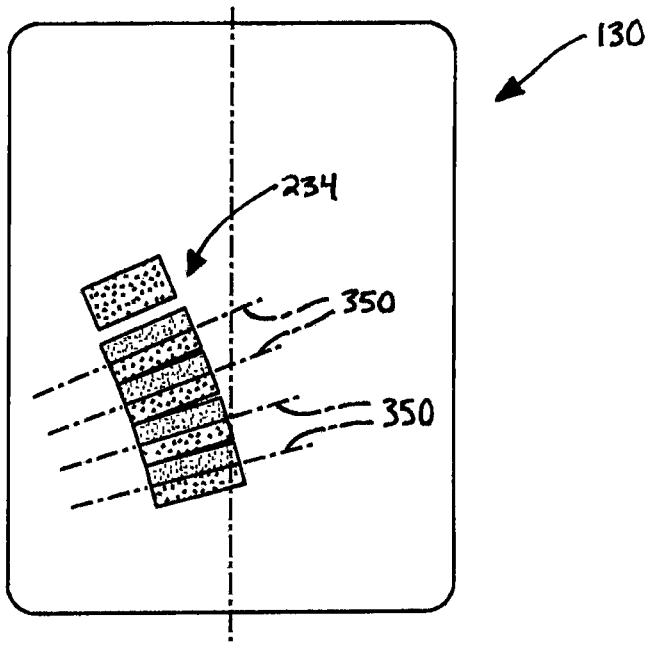
FIG. 7 is a rear view of the electronic mobile device support apparatus having finger receivers with non-parallel longitudinal axes.

Referring now to FIG. 7, in some embodiments one or more of the longitudinal axes 350 of the finger receivers 234 are non-parallel to each other. Such a configuration may be considered more comfortable to some users because it permits a user to spread their fingers apart when they are positioned in the finger receivers 234.

Figure 8:
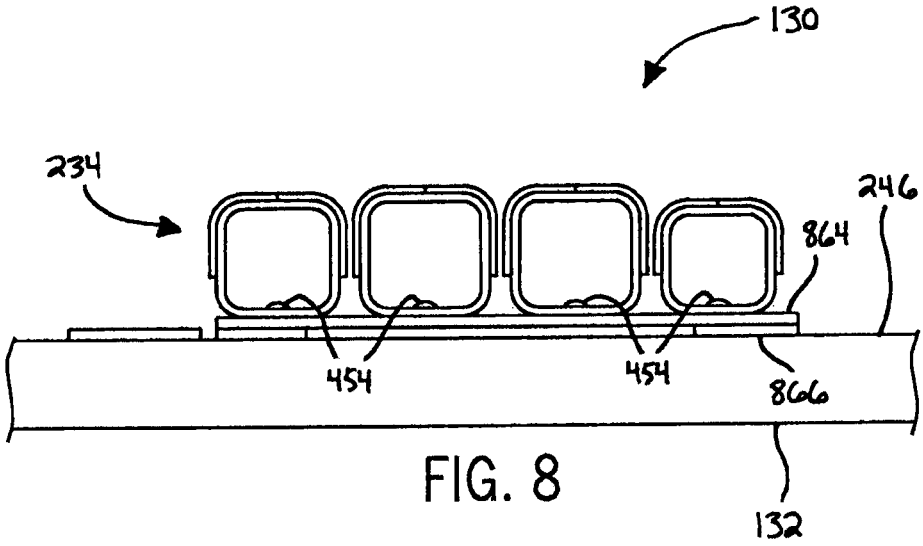
FIG. 8 is a side view of the electronic mobile device support apparatus having finger receivers that are detachably connected to a case of the support apparatus.
Figure 9:
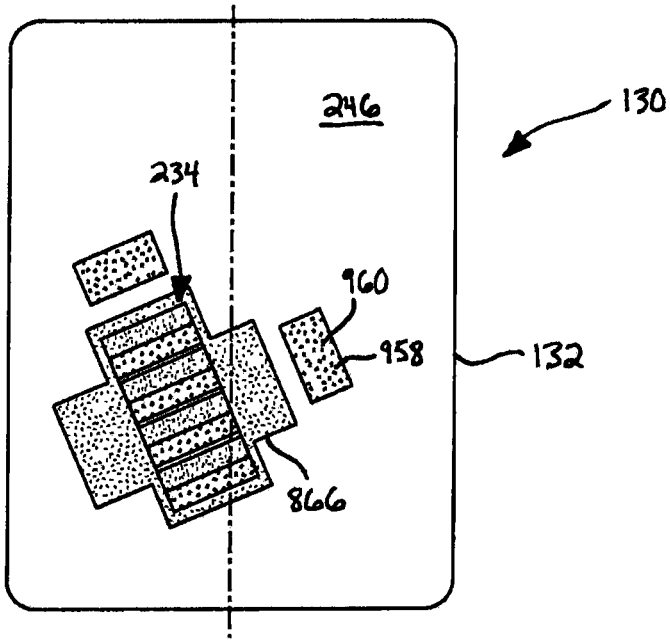
FIG. 9 is a rear view of the electronic mobile device support apparatus having the detachably connected finger receivers of FIG. 8.

Referring to FIGS. 8 and 9, in some embodiments the finger receivers 234 releasably connect to the rear surface 246 of the case 132. Specifically, the finger receivers 234 connect to a first connection pad 864 via stitches 454, an adhesive, or the like. The first connection pad 864 includes, e.g., Velcro® hooks to releasably engage a second connection pad 866 that includes, e.g., Velcro® loops. The second connection pad 866 connects to the rear surface 246 via stitches (not shown), an adhesive, or the like. The second connection pad 866 also has a generally X-shaped surface such that the first connection pad 864 and the finger receivers 234 may be detached therefrom, pivoted by 90 degrees, and reconnected to the second connection pad 866. In such a position, the finger receivers 234 are positioned such that the electronic mobile device 100 may be supported in a landscape operating mode. Furthermore, the rear surface 246 supports an additional pad 960 having a second connection surface 958 (e.g., Velcro® loops) such that the finger receivers 234 may be moved to the collapsed position in the landscape operating mode.

Figure 10A:
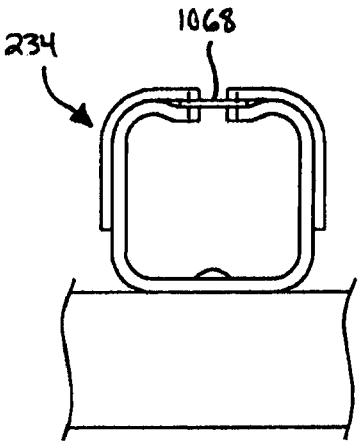
FIG. 10A is a side view of an elastic finger receiver in an unstretched configuration.
Figure 10B:
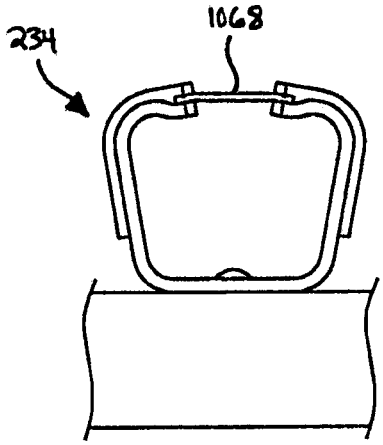
FIG. 10B is a side view of the elastic finger receiver of FIG. 10A in a stretched configuration.

Referring now to FIGS. 10A and 10B, in some embodiments the finger receivers 234 include one or more elastic sections 1068 (e.g., elastic fabric sections or elastic polymer sections) that permit the perimeter length of the fingers receivers 234 to vary. That is, the elastic sections 1068 permit finger receivers 234 to stretch to accommodate fingers of various sizes (e.g., child-size fingers and adult-size fingers).

Figure 11:
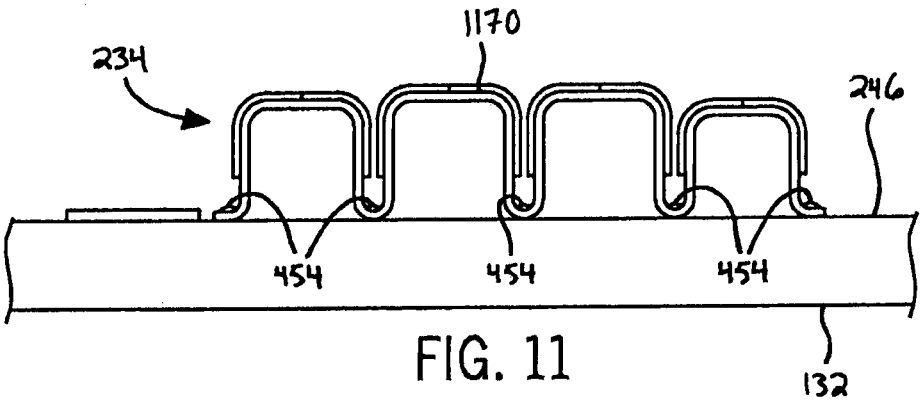
FIG. 11 is a side view of the electronic mobile device support apparatus having finger receivers that comprise a single strip of material.

Referring to FIG. 11, in some embodiments the finger receivers 234 are generally as described above except that they are defined by a single strip 1170 of material that follows a serpentine path that extends towards and away from the rear surface 246 of the case 132. Like the embodiments described above, exemplary materials for the strip 1170 include one or more of polymers (e.g., polycarbonate, polychloroprene, polyurethane, silicone, and rubber), fabrics (e.g., nylon), leather, imitation leather, and the like. The strip 1170 connects to the rear surface 246 via stitches 454, an adhesive, or the like. Such embodiments use less material than other embodiments described herein provided that the sizes of the finger receivers 234 are generally similar between the embodiments.

The structure of the support apparatus 130 can also differ from the above embodiments in other manners. For example, in some embodiments the case 132 is omitted from the support apparatus 130 and the finger receivers 234 directly connected to the rear surface of the electronic mobile device 100. As another example, in some embodiments the finger receivers are longitudinally offset from one another (e.g., by the distance the knuckles on the fingers are longitudinally offset from one another). As yet another example, in some embodiments the second connection pad 866 has a generally V-shaped surface such that the finger receivers 234 may be connected thereto in both right-handed and left-handed support configurations. As yet another example, the angle and position of the finger receivers 234 relative to the longitudinal axis 352 of the case 132 could be modified to suit other user preferences.

From the above description it should be apparent that the present disclosure provides an electronic mobile device support apparatus that permits a device user to practically and comfortably support large electronic mobile devices. Furthermore, it should also be apparent that the teachings of the present disclosure could also be applied to supports for small electronic mobile devices.

The various embodiments presented above are merely examples and are in no way meant to limit the scope of this disclosure. Variations of the embodiments described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

What is claimed is:

1. An electronic mobile device support apparatus comprising:

a plurality of generally tubular finger receivers disposed adjacent a rear surface of an electronic mobile device, each of the plurality of finger receivers defining a passageway configured to receive a corresponding finger of an electronic mobile device user such that the electronic mobile device is supportable thereby;

wherein the plurality of finger receivers are movable from a standing position to a collapsed position and vice versa, in the standing position each of the plurality of finger receivers being configured to receive the corresponding finger of the electronic mobile device user and in the collapsed position each of the plurality of finger receivers being flattened toward the rear surface of the electronic mobile device; and wherein at least one of the plurality of finger receivers includes a first connection surface that faces outwardly and away from the passageway defined by the at least one of the plurality of finger receivers, and at least another of the plurality of finger receivers includes a second connection surface that faces outwardly and away from the passageway defined by the at least another of the plurality of finger receivers, and the first connection surface is releasably engageable with the second connection surface to hold the at least one of the plurality of finger receivers in the collapsed position.

2. The electronic mobile device support apparatus of claim 1, wherein the at least another of the plurality of finger receivers includes a first connection surface, the electronic mobile device support apparatus further comprises a second connection surface disposed adjacent the rear surface of the electronic mobile device, and the first connection surface of the at least another of the plurality of finger receivers is releasably engageable with the second connection surface disposed adjacent the rear surface of the electronic mobile device to hold the at least another of the plurality of finger receivers in the collapsed position.

3. The electronic mobile device support apparatus of claim 1, wherein the plurality of finger receivers includes at least two finger receivers having substantially parallel longitudinal axes, and the plurality of finger receivers further includes at least one finger receiver having a longitudinal axis that is non-parallel to the longitudinal axes of the at least two finger receivers.

4. The electronic mobile device support apparatus of claim 1, wherein each of the plurality of finger receivers comprises an elastic section.

5. The electronic mobile device support apparatus of claim 1, further comprising a case defining an internal compartment configured to accommodate the electronic mobile device, the case having a rear surface supporting the plurality of finger receivers opposite the internal compartment.

6. The electronic mobile device support apparatus of claim 5, wherein the case defines a longitudinal axis and each of the plurality of finger receivers defines a longitudinal axis that is non-perpendicular to the longitudinal axis of the case.

7. The electronic mobile device support apparatus of claim 5, wherein the case includes a top, a bottom, sides, and a front bezel that define, together with the rear surface, the internal compartment.

8. The electronic mobile device support apparatus of claim 1, wherein the plurality of finger receivers are releasably supported adjacent the rear surface of the electronic mobile device.

9. The electronic mobile device support apparatus of claim 8, wherein the plurality of finger receivers are supported by a first connection pad that is releasably engageable with a second connection pad supported adjacent the rear surface of the electronic mobile device.

10. The electronic mobile device support apparatus of claim 1, wherein each of the plurality of finger receivers comprises a deformable material.

11. The electronic mobile device support apparatus of claim 10, wherein each of the plurality of finger receivers comprises at least one material selected from the group consisting of cloth, a polymer, and leather.

12. An electronic mobile device support apparatus comprising:

a case defining an internal compartment configured to accommodate an electronic mobile device, the case having a rear surface opposite the internal compartment;

a plurality of finger receivers connected to the rear surface, the plurality of finger receivers being movable from a standing position to a collapsed position and vice versa, in the standing position each of the plurality of finger receivers being configured to receive a corresponding single finger of a user and in the collapsed position each of the plurality of finger receivers being flattened toward the rear surface, and the plurality of finger receivers including:

at least one finger receiver including a first connection surface; and at least another finger receiver including a second connection surface, the first connection surface and the second connection surface being releasably engageable with each other to hold the at least one finger receiver in the collapsed position;

wherein the first connection surface faces outwardly and away from a passageway defined by the at least one finger receiver, and the second connection surface faces outwardly and away from a passageway defined by the at least another finger receiver.

13. The electronic mobile device support apparatus of claim 12, wherein the at least another finger receiver includes a first connection surface, the electronic mobile device support apparatus further comprises a pad supported by the rear surface and including a second connection surface, and the second connection surface of the pad is releasably engageable with the first connection surface of the at least another finger receiver to hold the at least another finger receiver in the collapsed position.

14. The electronic mobile device support apparatus of claim 12, wherein the case defines a longitudinal axis and each of the plurality of finger receivers defines a longitudinal axis that is non-perpendicular to the longitudinal axis of the case.

15. The electronic mobile device support apparatus of claim 12, wherein each of the plurality of finger receivers comprises an elastic section.

16. An electronic mobile device support apparatus comprising:

a case defining an internal compartment configured to accommodate an electronic mobile device, the case having a rear surface opposite the internal compartment; and a plurality of finger receivers releasably supported by the rear surface, the plurality of finger receivers being movable from a standing position to a collapsed position and vice versa, in the standing position each of the plurality of finger receivers being configured to receive a corresponding single finger of a user and in the collapsed position each of the plurality of finger receivers being flattened toward the rear surface;

wherein at least one of the plurality of finger receivers includes a first connection surface that faces outwardly and away from the passageway defined by the at least one of the plurality of finger receivers, and at least another of the plurality of finger receivers includes a second connection surface that faces outwardly and away from the passageway defined by the at least another of the plurality of finger receivers, and the first connection surface is releasably engageable with the second connection surface to hold the at least one of the plurality of finger receivers in the collapsed position.

17. The electronic mobile device support apparatus of claim 16, wherein the case defines a longitudinal axis and each of the plurality of finger receivers defines a longitudinal axis that is non-perpendicular to the longitudinal axis of the case.

18. The electronic mobile device support apparatus of claim 16, wherein the at least another of the plurality of finger receivers includes a first connection surface, the electronic mobile device support apparatus further comprises a second connection surface disposed adjacent the rear surface of the electronic mobile device, and the first connection surface of the at least another of the plurality of finger receivers is releasably engageable with the second connection surface disposed adjacent the rear surface of the electronic mobile device to hold the at least another of the plurality of finger receivers in the collapsed position.

19. The electronic mobile device support apparatus of claim 16, wherein the plurality of finger receivers includes at least two finger receivers having substantially parallel longitudinal axes, and the plurality of finger receivers further includes at least one finger receiver having a longitudinal axis that is non-parallel to the longitudinal axes of the at least two finger receivers.

20. The electronic mobile device support apparatus of claim 16, wherein each of the plurality of finger receivers comprises an elastic section.

* * * * *